US009496112B2

(12) United States Patent
Qin et al.

(10) Patent No.: US 9,496,112 B2
(45) Date of Patent: Nov. 15, 2016

(54) ELECTRIC DEVICE

(75) Inventors: Jifeng Qin, Zhuhai Guangdong (CN); Shaoyu Sun, Zhuhai Guangdong (CN); Dongjian Song, Zhuhai Guangdong (CN); Zhouquan He, Zhuhai Guangdong (CN)

(73) Assignee: EPCOS AG, Munich (DE)

( * ) Notice: Subject to any disclaimer, the term of this patent is extended or adjusted under 35 U.S.C. 154(b) by 374 days.

(21) Appl. No.: 14/128,725

(22) PCT Filed: Jun. 20, 2012

(86) PCT No.: PCT/EP2012/061878

§ 371 (c)(1),
(2), (4) Date: May 16, 2014

(87) PCT Pub. No.: WO2013/000795

PCT Pub. Date: Jan. 3, 2013

(65) Prior Publication Data

US 2014/0292472 A1 Oct. 2, 2014

(30) Foreign Application Priority Data

Jun. 30, 2011 (EP) ..... 11172213
Sep. 9, 2011 (EP) ..... 11180768
Sep. 15, 2011 (CN) ..... 2011 2 0352185 U

(51) Int. Cl.

*H01H 89/00* (2006.01)
*H01H 85/30* (2006.01)
*H01H 85/048* (2006.01)
*H01H 37/76* (2006.01)

(52) U.S. Cl.

CPC ..... *H01H 89/00* (2013.01); *H01H 85/306* (2013.01); *H01H 2037/762* (2013.01); *H01H 2085/0486* (2013.01)

(58) Field of Classification Search

CPC ..... H01H 85/306; H01H 89/00; H01H 2037/762; H01H 2085/0486
USPC ..... 337/5, 142
See application file for complete search history.

(56) References Cited

U.S. PATENT DOCUMENTS 3,242,290 A 3/1966 Tyler
3,638,083 A * 1/1972 Dornfeld ..... H01G 2/14 337/297

(Continued)

FOREIGN PATENT DOCUMENTS

CN 201331984 Y 10/2009
CN 101626156 A 1/2010

(Continued)

*Primary Examiner* — Anatoly Vortman
(74) *Attorney, Agent, or Firm* — Slater Matsil, LLP

(57) ABSTRACT

An electric device is disclosed. In an embodiment, the device includes an electric element having an element terminal and a conductive spring being deflected, the spring being electrically coupled to the element terminal by a fusible joint. The device further includes a switch including a first monitor terminal and a second monitor terminal, the switch having a state that is changeable between a first connection state, where the first monitor terminal and the second monitor terminal are electrically coupled, and a second connection state, where the first monitor terminal and the second monitor terminal are electrically decoupled, and wherein the electrical device is configured such that when the joint fuses, the spring relaxes, thereby decoupling the spring and the element terminal and changing the state of the switch.

13 Claims, 9 Drawing Sheets

(56) References Cited

U.S. PATENT DOCUMENTS

| | | | | |
|---|---|---|---|---|
| 3,696,316 | A | 10/1972 | Kitagawa et al. | |
| 4,288,833 | A * | 9/1981 | Howell | H02H 9/06 337/16 |
| 5,192,937 | A | 3/1993 | Lee | |
| 6,211,770 | B1 * | 4/2001 | Coyle | H01C 7/126 338/101 |
| 6,323,750 | B1 | 11/2001 | Lampl et al. | |
| 6,430,019 | B1 * | 8/2002 | Martenson | H01C 7/126 361/103 |
| 7,483,252 | B2 * | 1/2009 | de Palma | H01C 7/112 361/127 |
| 7,684,166 | B2 * | 3/2010 | Donati | H01C 7/126 361/103 |
| 8,174,353 | B2 * | 5/2012 | Jeong | H01C 1/022 338/20 |
| 8,279,575 | B2 | 10/2012 | Mao et al. | |
| 8,836,464 | B2 * | 9/2014 | Wang | H01C 7/126 337/401 |
| 9,165,702 | B2 * | 10/2015 | Hagerty | H01C 7/126 |
| 2005/0206493 | A1 * | 9/2005 | Chan | H01C 7/126 338/21 |
| 2008/0043395 | A1 * | 2/2008 | Donati | H01C 7/126 361/118 |
| 2008/0258858 | A1 | 10/2008 | Sun | |
| 2009/0316319 | A1 * | 12/2009 | Depping | H01C 7/126 361/91.1 |
| 2010/0328829 | A1 * | 12/2010 | Grewe | H01T 1/12 361/91.1 |
| 2011/0032651 | A1 * | 2/2011 | Depping | H01H 37/761 361/91.1 |
| 2012/0068806 | A1 * | 3/2012 | Guarniere | H01C 7/10 337/1 |
| 2014/0292472 | A1 | 10/2014 | Qin et al. | |

FOREIGN PATENT DOCUMENTS

| | | | |
|---|---|---|---|
| CN | 101741081 | A | 6/2010 |
| CN | 202434278 | U | 9/2012 |
| DE | 7536795 | U | 3/1976 |
| DE | 3643622 | A1 | 6/1988 |
| DE | 9012881 | U1 | 11/1990 |
| DE | 9115238 | U1 | 2/1992 |
| DE | 9305796 | U1 | 6/1993 |
| DE | 10039996 | A1 | 2/2002 |
| DE | 102006036598 | A1 | 10/2007 |
| DE | 102008031917 | A1 | 1/2010 |
| FR | 1318440 | A | 2/1963 |
| GB | 989428 | A | 4/1965 |
| GB | 1356578 | A | 6/1974 |
| GB | 2345187 | A | 6/2000 |
| JP | 472443 | A | 8/1972 |
| JP | 546541 | | 1/1979 |
| JP | 5895147 | U | 6/1983 |
| JP | 6088451 | U | 6/1985 |
| JP | 6261235 | A | 3/1987 |
| JP | 6345810 | Y2 | 11/1988 |
| JP | 454137 | U | 5/1992 |
| WO | 2008010410 | A1 | 1/2008 |

* cited by examiner

ELECTRIC DEVICE

This patent application is a national phase filing under section 371 of PCT/EP2012/061878, filed Jun. 20, 2012, which claims the priority of European patent application no. 11172213.8, filed Jun. 30, 2011, European patent application no. 11180768.1, filed Sep. 9, 2011, and Chinese patent application no. 201120352185.4, filed Sep. 15, 2011, each of which is incorporated herein by reference in its entirety.

TECHNICAL FIELD

The present invention relates in general to electric devices.

BACKGROUND

An electric device, e.g., comprising a varistor, may catch fire under abnormal overvoltage conditions, which may be prevented by a thermal fuse. A thermal fuse device may have a hybrid design comprising an electric element that may be an electronic component, e.g., a varistor, and a single thermal fuse. The device is designed to integrate functions of the element and thermal fuse functions. Power supply is applied via a fuse electrode and an element electrode, the fuse and the element being connected in series. When long duration abnormal overvoltage is applied to the element, e.g., the varistor, the thermal fuse provided between the fuse electrode and the element will form an open circuit to disconnect the whole device from the power supply, thereby avoiding catching fire.

The device may include a monitor function. Such device has a monitor terminal. Before disconnection of the fuse electrode and the element electrode, the monitor terminal and the fuse electrode are short-circuited and after disconnection of the fuse electrode and the element electrode the monitor terminal and the fuse electrode are open circuit, which may be detected by or may provide a signal for an external device to identify whether the thermal fuse inside is open or not. Since a connection state between the fuse electrode and the monitor terminal usually changes from a closed to an open state, only one signal can be provided for an external device: change normally closed to open. Moreover, the monitor terminal which is usually connected with a warning alarm device in a low voltage circuit has to be connected with the fuse terminal in a high voltage circuit. Thus, a single thermal fuse device, e.g., comprising a varistor, may need a complex monitor circuit design in a customer's application. On the other hand double thermal fuse devices may be used. Such a device may comprise a varistor and further has a separation between low and high voltage circuits, both comprising independent standard thermal fuses. Since it is unsure whether both thermal fuses act under abnormal overvoltage conditions at the same time, wrong signals may be provided for an external warning alarm device.

SUMMARY OF THE INVENTION

Embodiments of the invention provide an improved electric device comprising an element, a fuse and monitor means.

The electric device comprises an electric element having an element terminal and a conductive spring being deflected, the spring being electrically coupled to the element terminal by a fusible joint. The device further comprises a switch comprising a first monitor terminal and a second monitor terminal, the state of the switch being changeable between a first connection state, where the first monitor terminal and the second monitor terminal are electrically coupled, and a second connection state, where the first monitor terminal and the second monitor terminal are electrically decoupled. When the joint fuses, the spring relaxes, thereby decoupling the spring and the element terminal and changing the state of the switch. The joint may form a mechanical connection between the spring and the terminal element, where fusing of the joint enables relaxation of the spring, thereby disconnecting the spring and the element terminal. The spring is mechanically coupled with the switch in such a way that relaxation of the spring causes changing the state of the switch.

This device with abnormal overvoltage protection stays failure safe in an open circuit failure mode when the joint has fused. The device enables overvoltage protection with an integrated thermal fuse and provides a warning signal output by the monitor terminals.

The spring has a spring function and also serves as a conduction path. The device may solve the problem mentioned above: Disconnecting the spring and the element and changing the state at the same time is caused by melting of the joint, which ensures that the monitor terminals indicate the correct state of the spring. Preferably the spring and the monitor terminals are galvanically isolated from each other. On a primary side of the device the spring and the element can be used in a high voltage circuit and on a secondary side of the device the state of the device is indicated by the monitor terminals of the switch, where the monitor terminals can be coupled to low voltage circuit. Though the primary side and the secondary side are galvanically isolated, the relaxation of the spring changes the state of the primary and the secondary sides. In other words, the device acts as an ideal double fuse device having merely thermally connected fuses, wherein the spring and joint act like a first thermal fuse and the switch acts like a second thermal fuse.

The spring is mechanically coupled with the switch so that relaxation of the spring changes the state of the switch. Mechanically coupling may comprise that the spring touches the switch in such way that the spring forces or holds a part of the switch to a given position. In other words, if the spring moves due to the spring's elasticity, the part of the switch may move to another position, thereby changing the state of the switch.

Using the comparison with the double fuse device as mentioned above again, there is a means of mechanical connection with galvanic isolation acting like a thermal connection between the thermal fuse on the primary side and the thermal fuse on secondary side, wherein the thermal fuse on the primary side can be used in a high voltage circuit and the thermal fuse on the secondary side can be used in a low voltage circuit. It should be mentioned that although the device acts like a double thermal fuse, the device does not have two thermal fuses—there is actually only one fusible joint which reacts in dependence on the temperature.

The device, which may comprise a metal oxide varistor, has the function of abnormal overvoltage protection which can prevent the element, e.g., the varistor from catching fire, in the thermal open circuit failure mode. Galvanic isolation is provided between the switch and the spring. Further, signals for an alarm warning circuit are provided, which enables identifying whether the thermal fuse on the primary side is open or not. Compared with a single thermal fuse varistor, this arrangement simplifies integrating the warning circuit in the customer's application.

In one embodiment the switch comprises a moveable actuator, the switch being in one of the first and second connection states if the actuator is in an actuated position, the switch being in the other one of the first and second connection states if the actuator is in a released position. The actuator is in the released state if no force impacts to the actuator. The actuator may be pushed or pulled into the actuated state. The spring may be mechanically coupled with the actuator so that the actuator is in the actuated position wherein relaxation of the spring enables movement of the actuator to the relaxed position. In one embodiment, the spring has a first section mechanically contacting the actuator and pushing it to the actuated position and a second section that is electrically coupled with the element terminal.

In one embodiment the switch comprises a third monitor terminal, wherein in the first connection state the first monitor terminal and the third monitor terminal are electrically decoupled, and in the second connection state the first monitor terminal and the third monitor terminal are electrically coupled. Such a switch enables provision of two warning signal outputs for an external device: change normally closed to open and change normally open to closed. Either of them can be chosen in a customer's application.

In one embodiment the fusible joint comprises solder located between the second section and the element terminal, the solder preferably having a low melting temperature so that disconnection occurs in cause of overvoltage conditions.

In one embodiment the spring is made as one-piece and has a flat cross section. Such a spring may be bent by a metal sheet.

The device may comprise a housing where the spring is fixed to the housing so that the spring is deflected wherein the spring section that is connected to the element terminal moves away from the element terminal when the joint fuses.

The housing may comprise an inner wall that is an inner part of the housing where the element is arranged on one side of the inner wall and the spring and the switch are arranged on the other side of the inner wall.

The device may comprise an insulating wall that is located between the spring and the element terminal.

The device may comprise a first electrode connected with a body of the element and a second electrode formed by an end section of the spring. In one embodiment a third electrode electrically coupled with the second electrode is provided, the third electrode being electrically decoupled from the second electrode when the joint fuses.

BRIEF DESCRIPTION OF THE DRAWINGS

Further features, refinements and expediencies become apparent from the following description of the exemplary embodiments in connection with the Figures.

DETAILED DESCRIPTION OF ILLUSTRATIVE EMBODIMENTS

Figure 1:
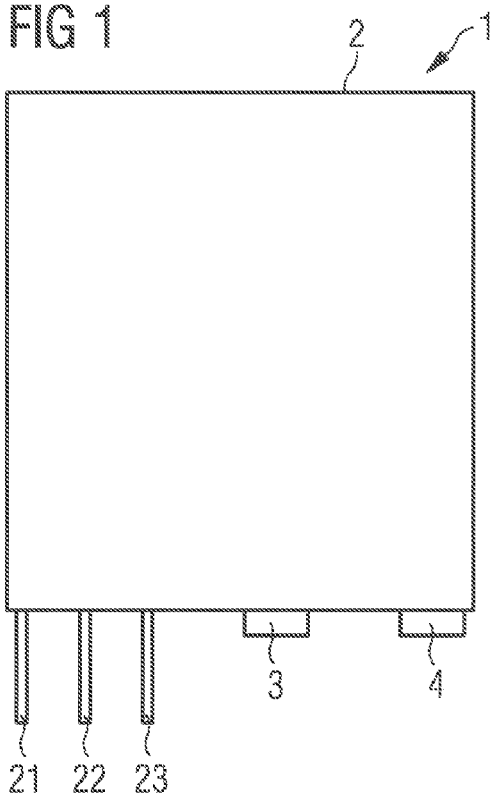
FIG. 1 shows a back view of an embodiment of an electric device.

FIG. 1 shows a back view of an embodiment of an electric device 1 which comprises a housing 2, a first electrode 3 and a second electrode 4. The housing 2 comprises an outer part shown in FIG. 1, e.g., top and bottom covers, and an inner housing located inside the outer housing. Alternatively the outer housing may be cap-shaped suitable for being attached over the inner housing. Driving potentials may be applied to the first and second electrodes 3, 4.

The device 1 further comprises monitor terminals 21, 22, 23 for providing information about the status of the device 1.

Figure 2:
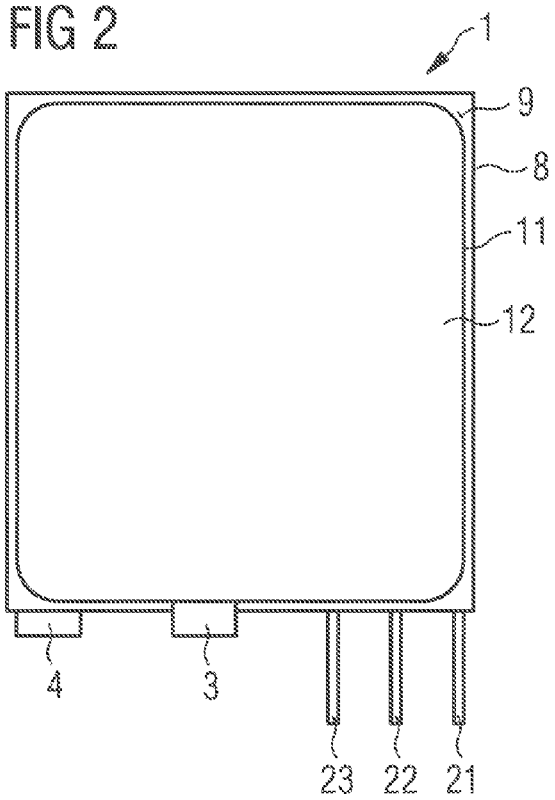
FIG. 2 shows a front view of the inside of the electric device shown in FIG. 1.

FIG. 2 shows a front view of the electric device 1 shown in FIG. 1, the outer housing being removed. The housing 2 comprises an inner wall 8 serving as inner housing and having a first side 9 and an opposing second side 10. An element 11, which may be a standard component, e.g., a standard metal oxide varistor, is located between the first side 9 of the inner wall 8 and the top side of the outer housing (not shown). The element 11 comprises a body 12 connected with the first electrode 3.

Figure 3:
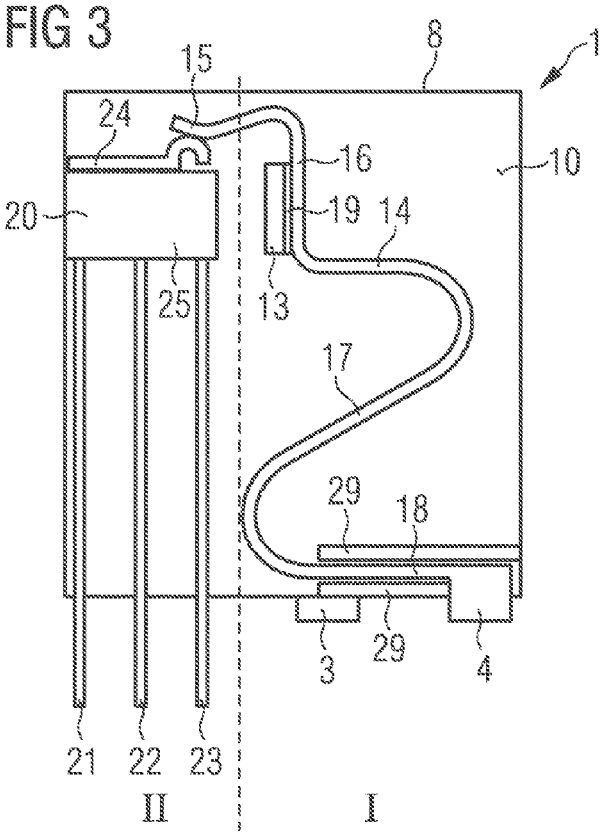
FIGS. 3 and 4 show back views of the inside of the electric device shown in FIGS. 1 and 2.

FIG. 3 shows a back view of the electric device 1 shown in FIGS. 1 and 2, the outer housing being removed. An element terminal 13 connected with the body 12 of the element 11 extends through a cut-out in the inner wall 8. The power supply is applied to the element 11 via the first electrode 3 and the element terminal 13.

A switch 20 is arranged between the second side 10 of the inner wall 8 and the bottom side of the outer housing (not shown). The switch 20 comprises a first, a second and a third monitor terminal 21, 22, 23 suitable for providing information about the state of the switch 20. The first, second and third monitor terminals 21, 22, 23 may be coupled with a warning circuit (not shown). The switch 20 may a subminiature basic switch having an actuator 24 that may be embodied as a leaf lever. The switch may be an electric switch that is actuated by very little physical force, through the use of a tipping-point mechanism. Switching happens reliably at specific and repeatable positions of the actuator.

The state of the switch 20 is changeable between a first connection state and a second connection state. In the first connection state the first monitor terminal 21 and the second monitor terminal 22 are electrically coupled, and the first monitor terminal 21 and the third monitor terminal 23 being electrically decoupled. In other words, the first monitor terminal 21 is a common terminal, the second terminal 22 is a normally closed terminal and the third terminal 23 is a normally open terminal in this application. In the second connection state the first monitor terminal 21 and the second monitor terminal 22 are electrically decoupled, and the first monitor terminal 21 and the third monitor terminal 23 being electrically coupled.

The state of the switch 20 depends on the position of the actuator 24, which can be moved from a released position to an actuated position when a force impacts the actuator 24. If no force impacts, the actuator 24 is in the released position, where the switch 20 is in the second state. In this embodiment the actuator 24 protrudes from a housing 25 of the switch 20 in the released position. In the actuated position the actuator 24 is pressed towards the housing 25 of the switch 20, the switch 20 being in the first state.

A spring 14 is arranged between the second side 10 of the inner wall 8 and the bottom side of the outer housing (not shown). The spring 14 has a first, second, third and fourth section 15, 16, 17, 18. The first section 15 is an end section which is arranged so that a part of the first section 15 pushes the actuator 24 of the switch 20 towards the housing 25 of the switch 20, where the actuator 24 is in the actuated position. The second section 16 is located adjacent to the element terminal 13, the second section 16 and the element terminal 13 are electrically coupled and mechanically connected by a fusible joint 19 that is located between the element terminal 13 and the second section 16. The third section 17 is an S-shaped section of the spring 14 enabling elastic deformation. The fourth section 18 comprises a section that is clamped between protrusions 29 of the inner wall 8 so that the spring 14 is fixed. The fourth section 18 further comprises an end section embodied as second electrode 4.

The spring 14 may be formed as one-piece, e.g., a stamping and/or bending part. The spring 14 may be made by an L-shaped metal sheet, one bent arm forming the electrode 4, the other bent arm forming the first, second, third and a part of the fourth section 15, 16, 17, 18. The spring 14 has a flat, e.g., rectangular or ellipsoid, cross section and is considered as a flat spring. Alternatively, the spring 14 may have a round cross section. The spring 14 is not limited to an S-shaped spring, other forms having a similar function, i.e., enabling disconnection from the element 11 under a given temperature, are possible.

The spring 14 may comprise bronze, e.g., ISO type CuSn6, with tin or nickel plating. It can be easy soldered with PCB and has a good electric conductivity and elasticity. This ensures transition of high electric current during normal operation and forming an open circuit under abnormal overvoltage conditions with high action speed and high reliability. The spring 14 may be made by others materials, e.g., steel alloy.

A joint 19 may comprise a low melting point temperature solder, e.g., a solder with the chemical content Sn 42% (percentage by weight) and Bi 58% (percentage by weight), having a melting point of 138° C., will act as the thermal fuse. It melts beyond 138° C. to release the spring 14, thereby forming an open circuit. Other materials with high electric conductivity and low melting point temperature can be used.

Plastic with high isolation strength and which is flame retardant may be suitable as housing material. Its high heat deformation temperature (more than 200° C.) ensures to support the spring 14, the element 11 and the switch 20 well under abnormal overvoltage conditions. PBT (mixed with glass fiber) or PPS is suitable as housing material.

The spring 14 is in a deflected state if the second section 16 and the element terminal 13 are connected. When the joint 19 melts, the spring 14 relaxes, which causes the second section 16 to move away from the element terminal 13 and the first section 15 to move away from the actuator 24, thereby the actuator 24 moves to the released position, which changes the state of the switch 20.

The fuse mechanism has a primary side I and a secondary side II, indicated by I and II and the dashed separation line in FIG. 3. The thermal fuse on the primary side is formed by the connection on the element terminal 13 and the spring 14 by means of the fusible joint 19. The switch 20 acts like a thermal fuse of the secondary side, since the state of the switch 20 is changed by mechanical coupling of the spring 14 and the actuator 24 when the joint 19 melts.

The primary side I and the secondary side II interact as follows. The temperature of the element 11, e.g., a metal oxide varistor, increases under abnormal overvoltage conditions. When abnormal overvoltage is applied to the second electrode 4 being part of the spring 14 and the first electrode 3 connected with the body 12 of the element 11 on the primary side and the heat generated by the abnormal overvoltage is high enough, the thermal fuse in the primary side, having a low melting point temperature and acting as a solder joint 19, between the first and second electrodes 3, 4 melts, thereby forming an open circuit between the first and second electrodes 3, 4 with the help of the elasticity of the flat spring 14. As a result, the electric current between the first and second electrodes 3, 4 is cut off and no overvoltage is applied to the element 11, e.g., the varistor, anymore, which can prevent the element 11 from catching fire.

Once the thermal fuse on the primary side I opens, the flat spring 14 will be disconnected from the element 11 and the pressure of the spring 14 onto the actuator 24 disappears, which causes release of the actuator 24 embodied as leaf lever of the switch 20. This movement of the actuator 24 changes the connection state of the switch 20 on the secondary side II.

Figure 4:
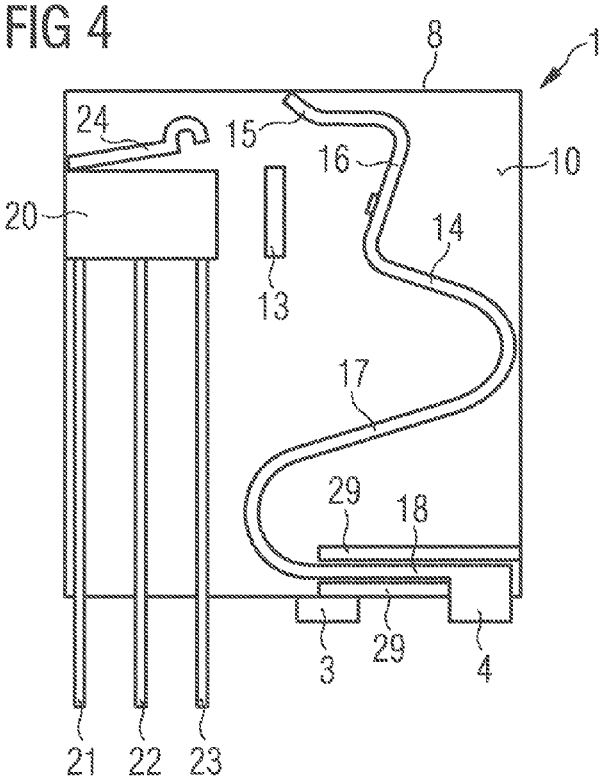

FIG. 4 shows the back view of the electric device 1 after melting of the joint 19. The spring 14 has moved away from the element terminal 13 and the actuator 24, thereby disconnecting the spring 14 and the element terminal 13 and enabling release of the actuator 24 to the released position, so that the connection state of the switch 20 changes.

Figure 5:
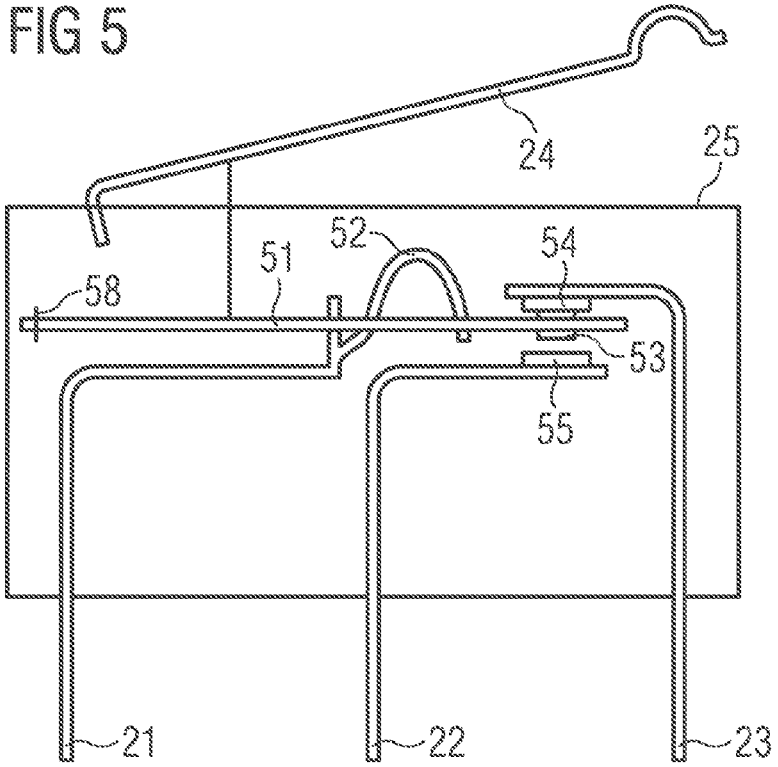
FIG. 5 illustrates the function of an embodiment of a switch.

FIG. 5 illustrates the function of an embodiment of the switch 20 that comprises a housing 25, monitor terminals 21, 22, 23 and a first and a second conductive spring 51, 52. The actuator 24 is galvanically isolated from the monitor terminals 21, 22, 23 and the first and second springs 51, 52.

The first spring 51 is a long and flat spring fixed at one end 58 of the housing 25 and having electrical contacts 53 on the other end. If the actuator 24 is in the released position (as shown in FIG. 5) a small curved second spring 52 pushes the first spring 51 upward so that the first and third monitor terminals 21, 23 are electrically coupled, the first and second monitor terminals 21, 22 being electrically decoupled.

When the actuator 24 is pushed downwards to the actuated position, it flexes the first spring 50 and the electrical contact 53 moves from the contact 54 of the third monitor terminal 23 to the contact 55 of the second monitor terminal 22, so that the first and second monitor terminals 21, 22 are coupled, the first and third monitor terminals 21, 23 being electrically decoupled.

If no force impacts to the actuator 24, the elasticity of the first spring 51 forces the actuator 24 back to the released position.

Figure 6:
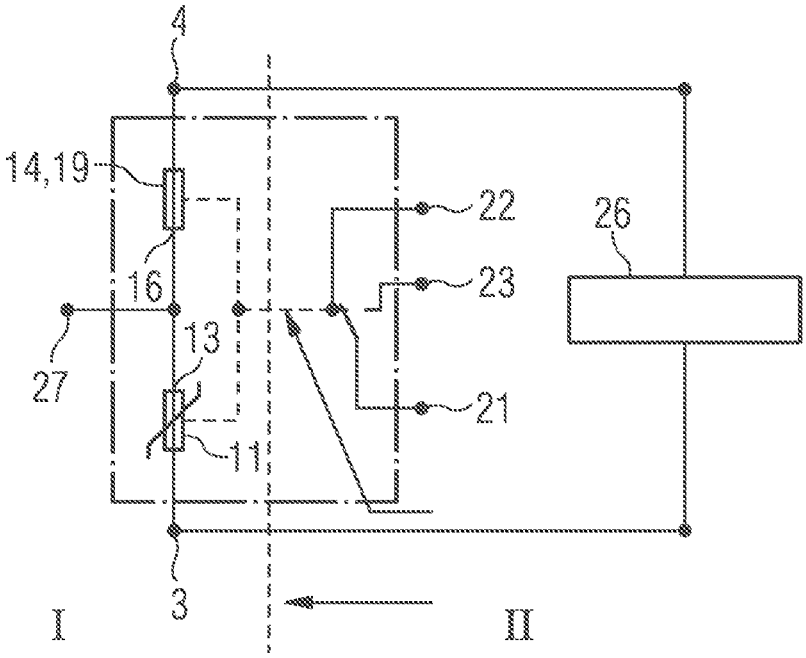
FIG. 6 shows a circuit diagram of the device.

FIG. 6 shows a circuit diagram of the device 1. The device 1 may be used for protection of a further device or circuit 26. The power supply for the further device 26 is also applied between the first and second electrode 4, 3 indicated as potential node in the diagram. The spring 14, the joint 19 and the element 11 are connected in series between the second and first electrode 4, 3 on the primary side I. The second electrode 4 may be coupled with a "line" potential. The first electrode 3 may be coupled with a "neutral" potential. The first monitor terminal 21 is a common terminal. The second terminal 22 is a normally closed terminal. The third terminal 23 is a normally open terminal. There is only a thermal connection, as explained above, between the primary and secondary side, the thermal connection being indicated by the arrow. Moreover, there is a galvanic isolation between the primary and secondary sides indicated by the dashed line.

Based on a single thermal fuse device including the joint connecting the element terminal 13 and the spring 14, the switch 20 is provided for acting like a thermal fuse on the secondary side II, the switch 20 having a mechanical linkage with the flat spring 14 on the primary side I. Once the thermal fuse, namely the joint 19, on the primary side I melts and the flat spring 14 relaxes, the actuator 24 of the switch 20 is released to change the connection status of the monitor terminals 21, 22, 23 at the same time.

Reference numeral 27 indicates a potential node of a third electrode (not shown in previous FIGS. 1 to 4) coupled between the spring 14 and the element terminal 13, the third electrode 27 being electrically decoupled from the second electrode 4 after melting of the joint 19. The electrode 3 is also suitable for indicating the state of the device 1, if monitoring whether the second and third electrodes 4, 27 are electrically coupled.

The following connection states are possible in the circuit described above. In the first state, the thermal fuse is closed during normal operation and the first and second monitor terminals 21, 22 are electrically coupled while the first and third monitor terminals 21, 23 are electrically decoupled. In the second state, the thermal fuse is open and the first and second monitor terminals 21, 22 are electrically decoupled while the first and third monitor terminals 21, 23 are electrically coupled.

Due to high galvanic isolation between the actuator 24 of the switch 20 and the monitor terminals 21, 22, 23 there is also a high galvanic isolation between the primary side I and the secondary side II. The monitor terminals 21, 22, 23 on the secondary side can be connected with a warning alarm device (not shown) in a low voltage circuit and the first and second electrodes 3, 4 can be connected in parallel with a device or circuit 26 to be protected in a high voltage circuit. The monitor terminals 21, 22, 23 can provide two signals for generating a warning alarm: change normally closed to open (if the first and second monitor terminals 21, 22 are used) and change normally open to closed (if the first and third monitor terminals 21, 23 are used). The spring 14 and the switch 20 considered as thermal fuses on the primary and secondary side can reliably act at the same time, since they are mechanically coupled. This device acting like an ideal double thermal fuse device which may comprise a varistor element can simplify a warning circuit in a customer's application.

Figure 8:
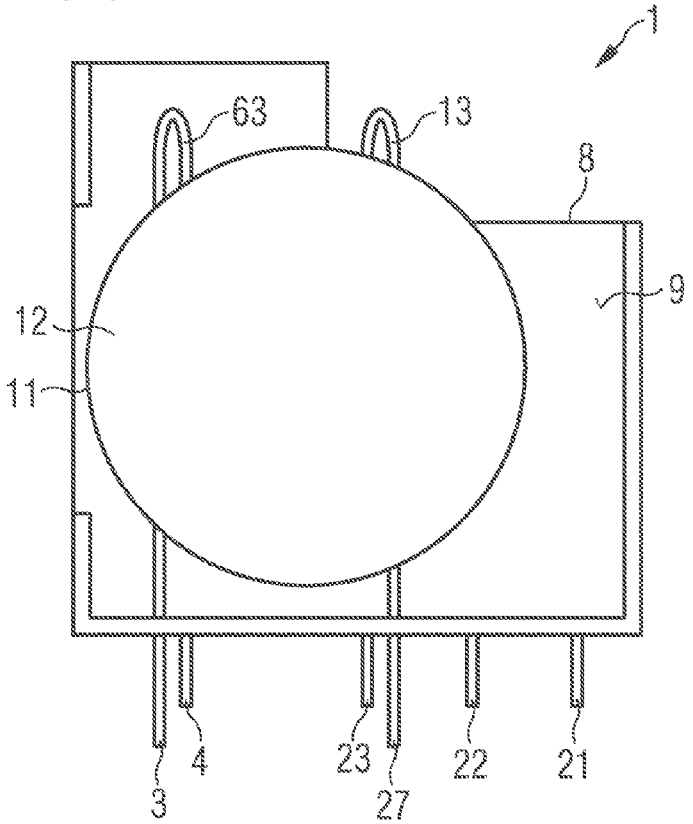
FIGS. 8 and 10 show a front view of the inside of a further embodiment of the device.
Figure 9:
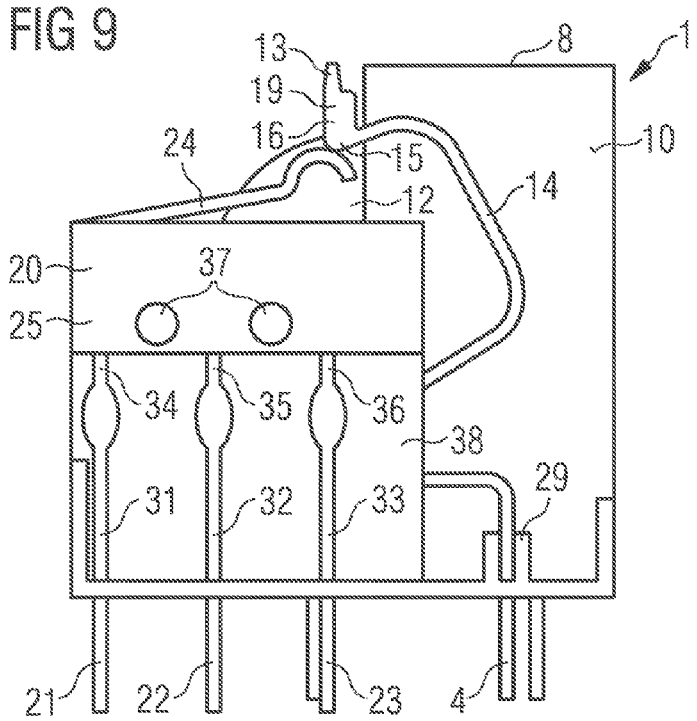
FIG. 9 shows a back view of the inside of the embodiment of the device shown in FIG. 8.
Figure 10:
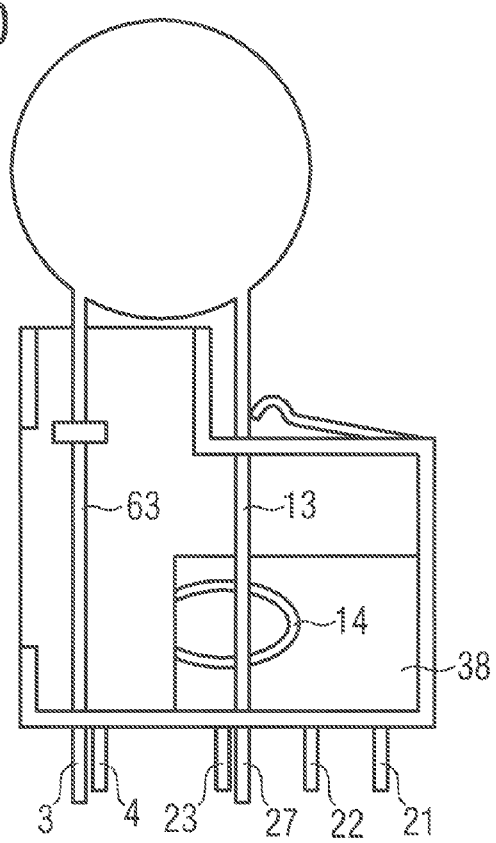

The circuit diagram shown in FIG. 6 corresponds to embodiments having six pins as, e.g., shown in FIGS. 8 to 10.

Figure 7:
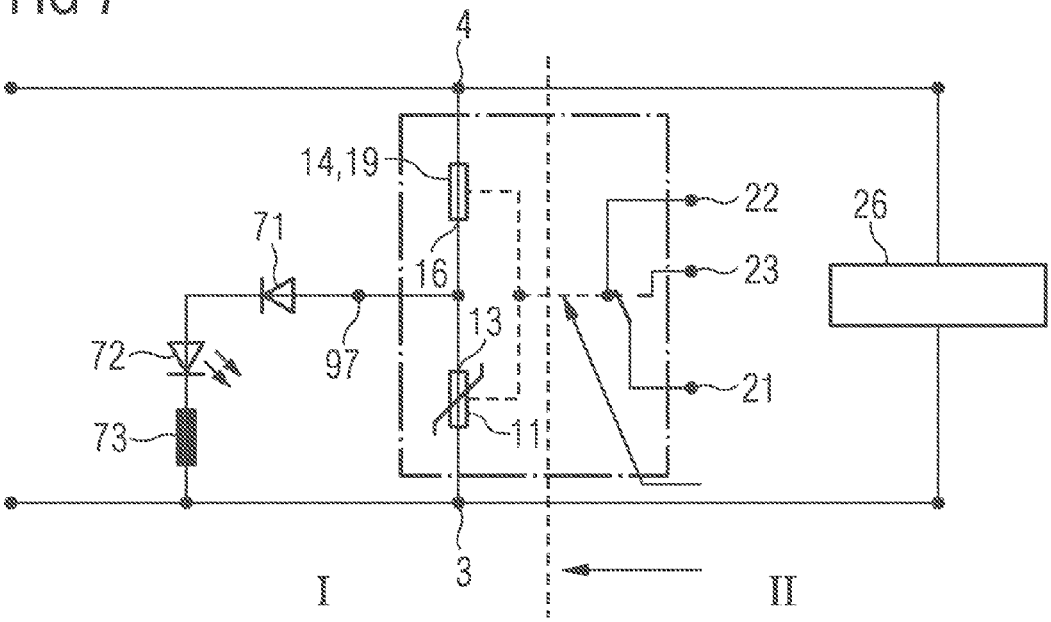
FIG. 7 shows a further circuit diagram of the device.

FIG. 7 shows a further circuit diagram based on the circuit diagram shown in FIG. 6 wherein a series connection of a diode 71, an LED 72 and a resistor 73 is coupled between a potential node 97 and the first electrode 3, which means the series connection of the diode 71, the LED 72 and the resistor 73 is coupled in parallel to the element 11. The potential node 97 is located between the spring 14 and the element terminal 13, the node 97 being electrically decoupled from the second electrode 4 after melting of the joint 19. A third electrode is not provided.

In the first state, the thermal fuse is closed during normal operation and the first and second monitor terminals 21, 22 are electrically coupled while the first and third monitor terminals 21, 23 are electrically decoupled. The electrical connection between the first end second electrodes 3, 4 is indicated by the state of the LED 72, since there is current path along the thermal fuse and the series connection of the diode 71, the LED 72 and the resistor 73.

In the second state, the thermal fuse is open and the first and second monitor terminals 21, 22 are electrically decoupled while the first and third monitor terminals 21, 23 are electrically coupled. The electrical disconnection between first end second electrodes 3, 4 is indicated by the state of the LED that has changed, since the path between the first and second electrode 4, 3 is interrupted.

The circuit diagram shown in FIG. 7 may correspond to embodiments having five pins, e.g., the first and second electrodes 3, 4 and the monitor terminals 21, 22, 23, as shown in FIGS. 1 to 4.

FIG. 8 shows the front view of the inside of a further embodiment of the device 1. The housing 2 comprises an inner housing 8 having a first side 9 and an opposing second side 10. The sides 9, 10 are not plan.

The wall 8 has a rectangular cut-off so that the wall 8 is L-shaped. An element 11, that is a varistor in this embodiment, is arranged adjacent to the first side 9. The element 11 comprises a body 12, an element terminal 13 and a further terminal 63. The terminals 13, 63 are elongated wires connected with a top edge of the body 12. The wires are bent so that they run between the body 12 and the inner wall 8. The bending section of element terminal 13 is positioned at the cut-off. The terminals 13, 63 run through holes in a bottom region of the inner wall 8 wherein the parts outside the housing 2 serve as electrodes. The end section of the further terminal 63 forms the first electrode 3. The end section of the element terminal 13 forms a third electrode 27.

FIG. 9 shows the back view of the inside of the embodiment of the device 1 shown in FIG. 8. A switch 20 and a spring 14 are arranged between the inner wall 8 and the outer housing (not shown). The switch 20 comprises a first, second and third monitor terminal 21, 22, 23 that are elongated conductive elements 31, 32, 33 connected by soldering with a first, second and third pin 34, 35, 36 protruding from the housing 25. The switch 20 is fixed to the inner wall 8 of the housing by attachment so that protrusions 37 of the inner wall 8 are located in holes in the housing 25 of the switch 20.

The spring 14 is arranged in a deflected state so that the first section 15 of the spring 14 pushes the actuator 24 of the switch 20 towards the housing 25, the actuator 24 being in the actuated state. The second section 16 of the spring 14 is an end section that is electrically coupled and mechanically connected with the element terminal 13 by a solder joint 19. In this embodiment the solder joint 19 is located near the first section 15 that pushes the actuator 24. The spring 14 runs through a hole in the bottom region of the inner wall 8, the projecting part serving as second electrode 4.

A protruding part 38 of the inner wall 8 is located behind the monitor terminals 21, 22, 23. This part 38 separates the monitor terminal 21, 22, 23 and a part of the spring 14 that runs behind this part 38 of the wall. The spring 14 is fixed by protrusions 29 of the inner wall 8, the protrusions 29 clamping the spring 14.

When abnormal overvoltage exceeding a given value is applied between the first and second electrodes 3, 4, the joint 19 melts, which enables relaxation of the spring 14 so that the first and second sections 15, 16 of the spring 14 move away from the actuator 24 and the element terminal 13, thereby disconnecting the actuator 24 and the element terminal 13 and changing the connection state of the monitor terminals 21, 22, 23 because the actuator 24 moves in the released position.

FIG. 10 shows the front view of the inside of the embodiment shown in FIGS. 8 and 9. In this view the element 12 is bent upwards enabling to view the arrangement of the terminals 13, 63 running behind the element (if it is in its normal position as shown in FIG. 8). The part of spring 14 running behind the protruding wall 38 is also visible.

In this embodiment a curved part of the spring 14 that runs behind the protruding wall 38 may be located closely to the element terminal 13, that forms the third electrode 27, without any insulation means between them. During normal operation the spring 14 and the third electrode 2 are actually short-circuited since they are electrically coupled by the solder joint 19 or thermal fuse. After melting of the joint 19 an open circuit is formed. The space between the terminal 13 and the spring 14 prevents a short circuit. There may a distance of at least 1 mm between the spring 14 and the terminal 13 such as they are separated by a housing wall.

Figure 11:
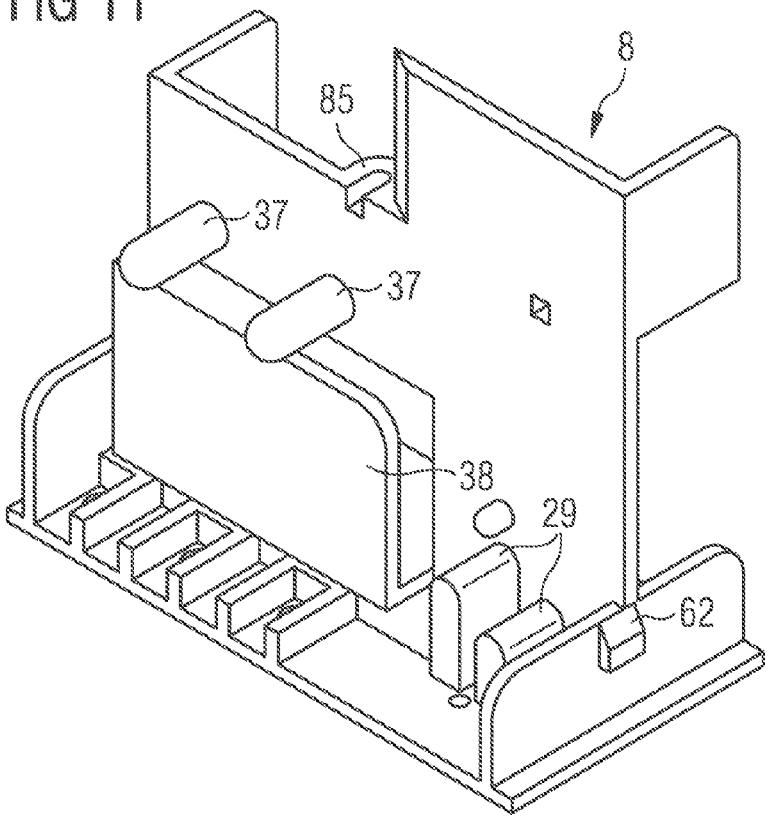
FIG. 11 shows the three dimensional back view of the inner housing of the embodiment shown in FIGS. 8 to 10.

FIG. 11 shows a three-dimensional back view of the inner wall 8 of the embodiment shown in FIGS. 8 to 10. The means for attaching the other parts of the device are clearly shown. These means are formed as protrusion 37, 29 enabling attachment and clamping of the switch 20 and the spring 14. There is enough space behind the protruding wall portion 38 to enable the positioning of the spring 14 between the inner wall and its protruding wall portion 38.

Figure 12:
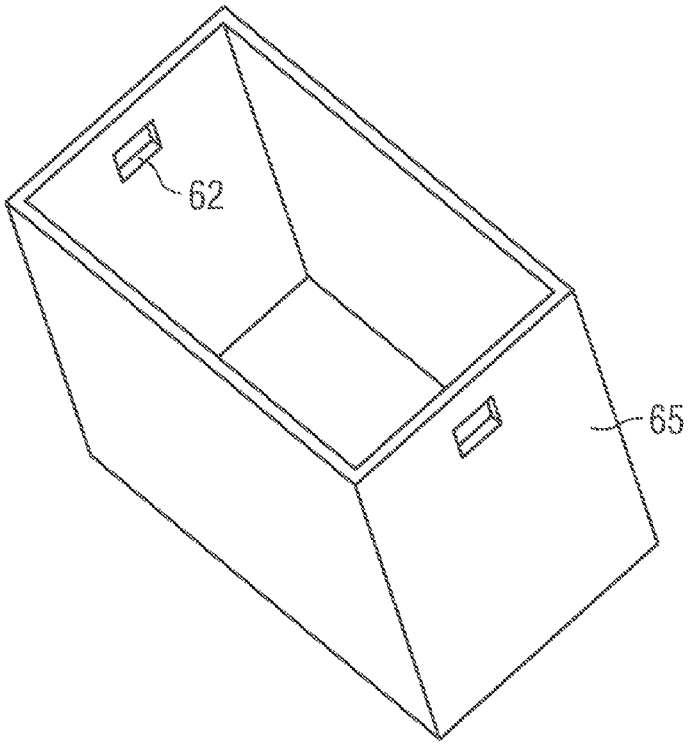
FIG. 12 show the three dimensional view of an outer housing of the embodiment shown in FIGS. 8 to 11.

FIG. 12 shows a three-dimensional view of the outer housing 65 which is formed as cap that may be attached to the inner housing wall 8 shown in FIGS. 8 to 11 and fixed by snapping means 62.

Figure 13:
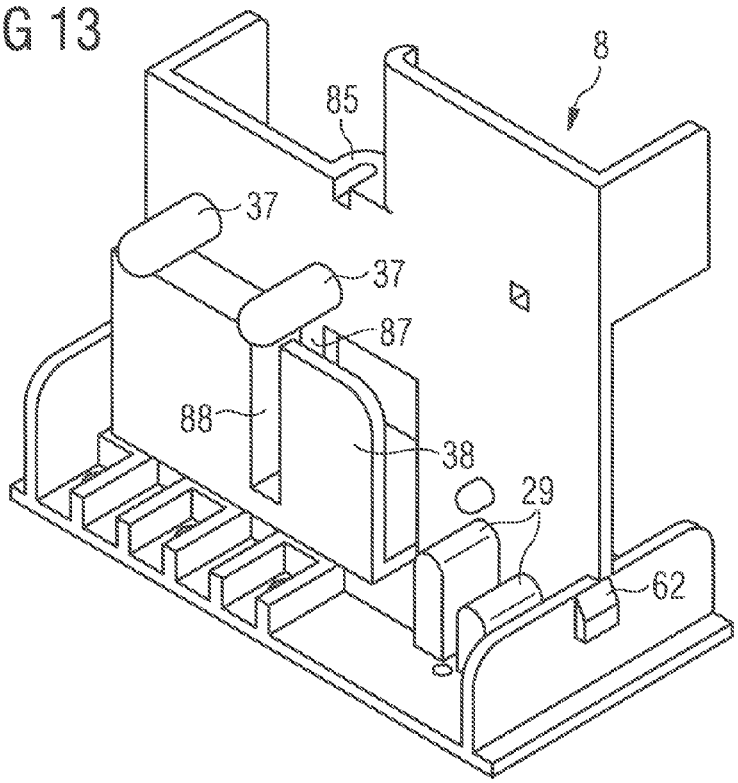
FIG. 13 shows a three-dimensional back view of an inner housing of a further embodiment.
Figure 14:
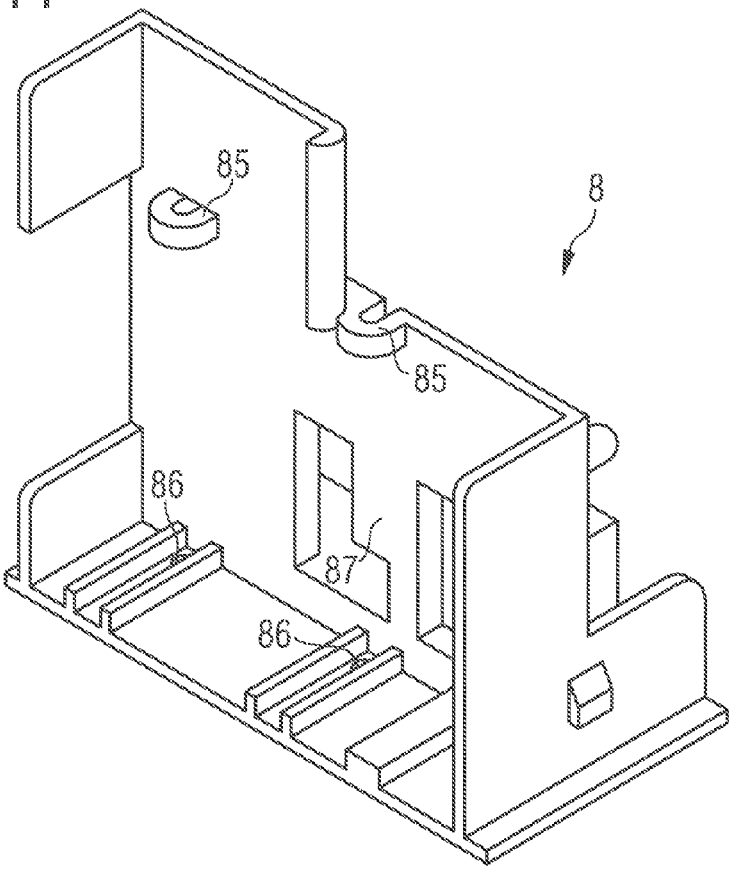
FIG. 14 shows a three-dimensional front view of the inner housing of the embodiment shown in FIG. 13.

FIG. 13 shows a three-dimensional back view of an inner wall 8 of a further embodiment. FIG. 14 shows a three-dimensional front view of the inner wall 8 of the embodiment shown in FIG. 13.

Figure 15:
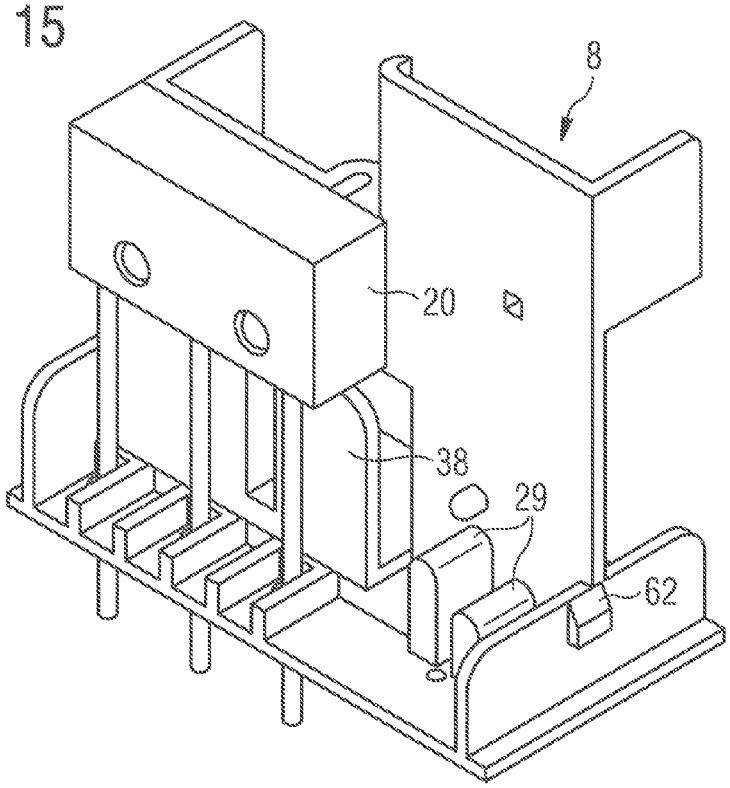
FIG. 15 shows a three-dimensional back view of the inner housing and the switch of the embodiment shown in FIGS. 13 and 14.
Figure 16:
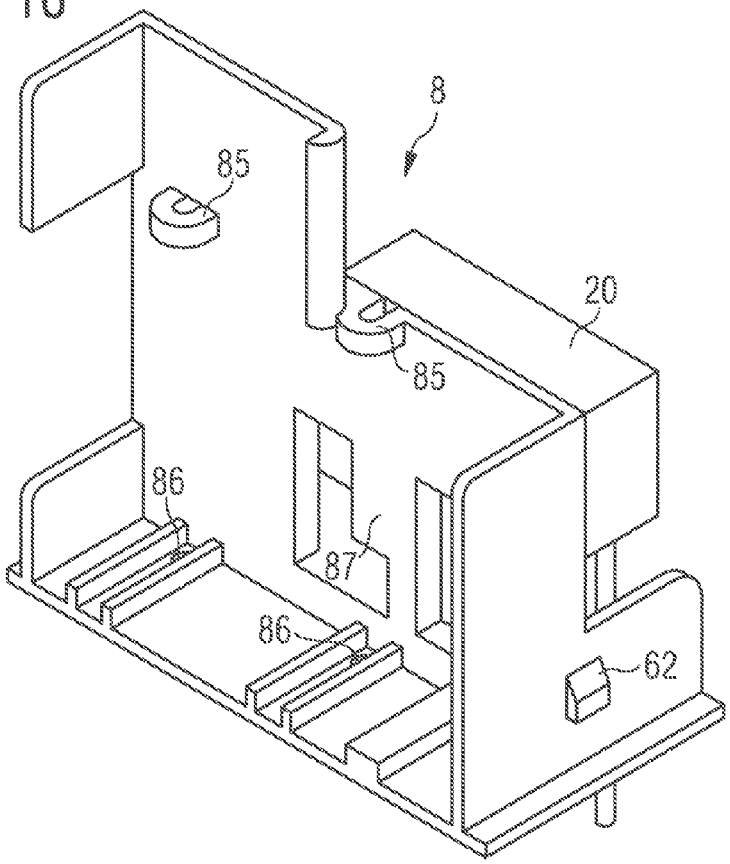
FIG. 16 shows a three-dimensional front view of the inner housing and the switch of the embodiment shown in FIGS. 13, 14 and 15.

FIG. 15 shows a three-dimensional back view of the inner wall 8 of the embodiment where the switch 20 is mounted. FIG. 16 shows a three-dimensional front view of the inner wall 8 and the switch 20 of the embodiment shown in FIG. 15.

The inner wall 8 shown in FIGS. 13 to 16 comprises holding means 85 formed as protrusions having a hole and located on the front side. The terminals 63, 13 of the element 11 (not shown in FIGS. 13 to 16) run through the holding means 85 and holes 86 located in the bottom side of the inner wall 8.

The inner wall 8 shown in FIGS. 13 to 16 differs from the inner wall 8 shown in FIG. 11 by an insulating wall portion 87 that is located between the spring 14 and the element terminal 13. The spring 14 and the terminal 13 are insulated by the wall portion 87, which prevents that the spring 14 and the terminal 13 are short circuited after melting of the joint 19.

The housing design with an insulation wall portion 87 that may be made of plastic provided between the spring 14 and the terminal 13 eliminates the risk of a short circuit between the spring 14 and the terminal 13.

It should be mentioned that the gap 88, that may be formed as rectangular through hole in the protruding wall 38, shown in FIG. 13 is a design feature due to housing molding process limits.

Figure 17:
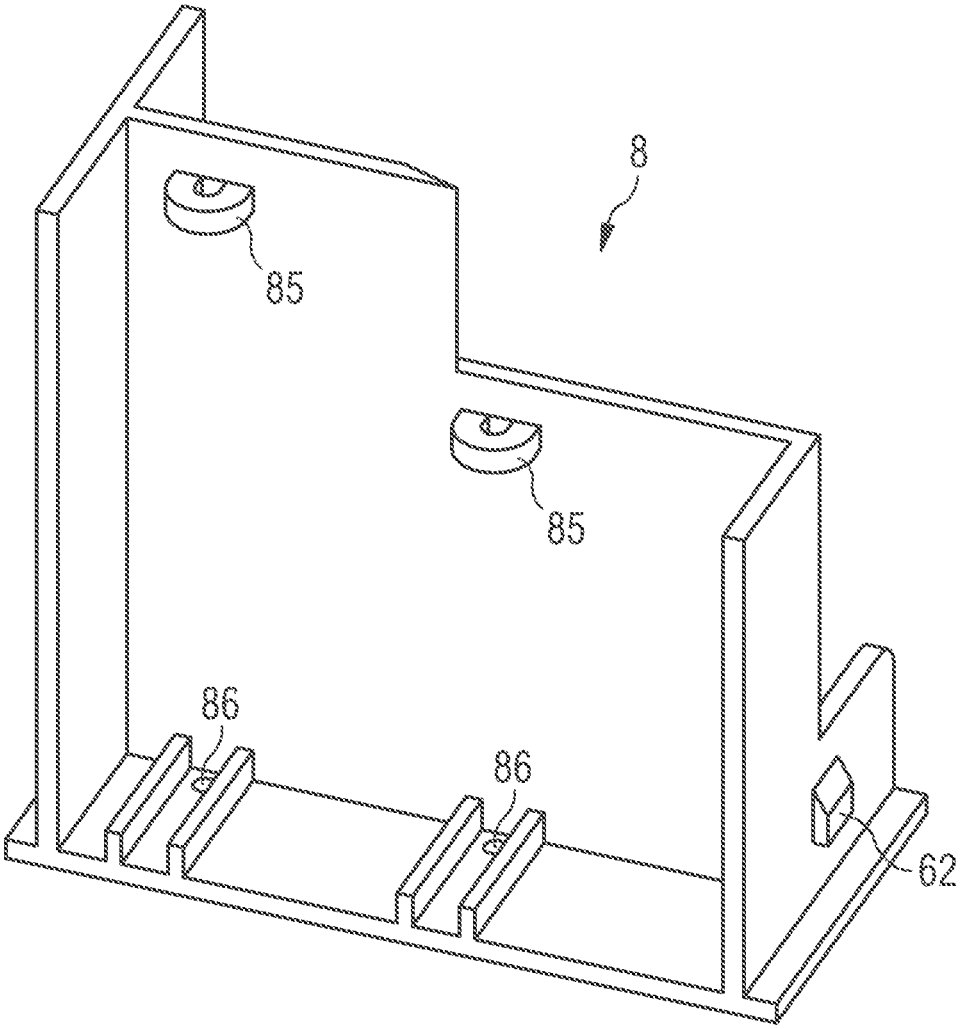
FIG. 17 shows a three-dimensional front view of an inner housing of a further embodiment.

FIG. 17 shows a three-dimensional front view of an inner wall 8 of a further embodiment, the wall having a first and a second side.

The wall 8 has a rectangular cut-off so that the wall 8 is L-shaped. An element 11 (not shown in FIG. 17) is arranged adjacent to one side. The spring 14 and the switch 20 (not shown in FIG. 17) are located on the opposite side. Contrary to the embodiments mentioned above, this embodiment does not have openings between the first and second sides. The solid wall serving as insulating means between the spring 14 and the terminals 13, 63 ensures that the spring 14 and the terminals 13, 63 are insulated and a short-circuit is avoided.

It is mentioned that the features of the embodiments mentioned in the specification can be combined.

The invention claimed is:

1. An electric device comprising:

an electric element having an element terminal;

a conductive spring being deflected, the spring being electrically coupled to the element terminal by a fusible joint;

a housing comprising an inner wall, wherein the spring is fixed to the housing so that the spring is deflected, wherein a spring section that is connected to the element terminal moves away from the element terminal when the joint fuses;

a switch comprising:

a first monitor terminal;

a second monitor terminal; and a third monitor terminal, wherein the switch has a state that is changeable between a first connection state, where the first monitor terminal and the second monitor terminal are electrically coupled, and a second connection state, where the first monitor terminal and the second monitor terminal are electrically decoupled, and wherein, in the first connection state, the first monitor terminal and the third monitor terminal are electrically decoupled and wherein, in the second connection state, the first monitor terminal and the third monitor terminal are electrically coupled, wherein the electric element is arranged on one side of the inner wall and the spring and the switch are arranged on the other side of the inner wall, and wherein the electrical device is configured such that when the joint fuses, the spring relaxes, thereby decoupling the spring and the element terminal and changing the state of the switch.

2. The device according to claim 1, wherein the spring and the monitor terminals are galvanically isolated from each other.

3. The device according to claim 1, wherein the spring is mechanically coupled with the switch so that relaxation of the spring changes the state of the switch.

4. The device according to claim 1, wherein the switch comprises a moveable actuator, the switch being in one of the first and second connection states if the actuator is an actuated position, the switch being in the other one of the first and second connection states if the actuator is in a released position.

5. The device according to claim 4, wherein the spring is mechanically coupled with the actuator so that the actuator is in the actuated position and wherein relaxation of the spring enables movement of the actuator to the released position.

6. The device according to claim 4, wherein the spring has a first section mechanically contacting the actuator and holding it in the actuated position and a second section that is connected with the element terminal by the joint.

7. The device according to claim 6, wherein the fusible joint comprises solder located between the second section and the element terminal.

8. The device according to claim 1, wherein the spring is one-piece and has a flat cross section.

9. The device according to claim 1, further comprising an insulating wall located between the spring and the element terminal.

10. The device according to claim 1, further comprising a first electrode connected with a body of the electric element and a second electrode formed by an end section of the spring.

11. The device according to claim 10, further comprising a third electrode electrically coupled with the second electrode, the third electrode being electrically decoupled from the second electrode when the joint fuses.

12. The device according to claim 1, wherein the electric element comprises a varistor.

13. A method for using an electric device, the electrical device comprising:

an electric element having an element terminal;

a conductive spring being deflected so as to be electrically coupled to the element terminal by a fusible joint;

a housing comprising an inner wall, wherein the spring is fixed to the housing so that the spring is deflected, wherein a spring section that is connected to the element terminal moves away from the element terminal when the joint fuses;

a switch comprising:

a first monitor terminal;

a second monitor terminal; and a third monitor terminal, wherein the switch has a state that is changeable between a first connection state, where the first monitor terminal and the second monitor terminal are electrically coupled, and a second connection state, where the first monitor terminal and the second monitor terminal are electrically decoupled, and wherein, in the first connection state, the first monitor terminal and the third monitor terminal are electrically decoupled and wherein, in the second connection state, the first monitor terminal and the third monitor terminal are electrically coupled, wherein the electric element is arranged on one side of the inner wall and the spring and the switch are arranged on the other side of the inner wall, and wherein the method comprises:

experiencing a condition that causes the joint to fuse and the spring to relax;

decoupling the spring and the element terminal due to relaxing of the spring; and changing the state of the switch between the first connection state and the second connection state.

* * * * *